United States Patent [19]

Serra et al.

[11] Patent Number: 4,776,318

[45] Date of Patent: Oct. 11, 1988

[54] PORTABLE COOKING DEVICE WITH SAFETY RETAINER

[76] Inventors: Charles Serra, 8342 Coralberry La., Jacksonville, Fla. 32244; Henry K. Leialoha, Jr., 3677 Cavanaugh Dr., Jacksonville, Fla. 32211

[21] Appl. No.: 14,393

[22] Filed: Feb. 13, 1987

[51] Int. Cl.[4] ..... F24C 5/20

[52] U.S. Cl. ..... 126/38; 126/9 R; 126/9 B; 126/39 R; 126/50

[58] Field of Search ..... 126/9 R, 9 B, 38, 39 R, 126/44, 50; 431/344; 239/552

[56] References Cited

U.S. PATENT DOCUMENTS

| | | | |
|---|---|---|---|
| 166,767 | 8/1875 | Gorham | 126/38 |
| 946,690 | 1/1910 | Szakáll et al. | 126/256 |
| 1,028,901 | 6/1912 | Nelson | 126/38 |
| 2,331,931 | 10/1943 | Robinson | 126/38 |
| 2,354,221 | 7/1944 | Robinson | 126/38 |
| 2,498,682 | 2/1950 | Howard | 126/38 |
| 2,574,635 | 11/1951 | Franzheim | 239/552 X |
| 4,082,993 | 4/1978 | Oakes | 137/322 |
| 4,192,284 | 3/1980 | Vache | 126/38 |

*Primary Examiner*—Samuel Scott
*Assistant Examiner*—Allen J. Flanigan
*Attorney, Agent, or Firm*—Thomas C. Saitta

[57] ABSTRACT

A portable cooking device having a centrally disposed burner, with utensil support members having short horizontal arms to hold small cooking utensils above the burner as well as having a shoulder configuration to hold a large pot. A removable annular retaining ring encircles the pot to prevent it from sliding. The burner has channels in the inner wall of the burner body to provide better burning of the fuel mixture.

13 Claims, 2 Drawing Sheets

PORTABLE COOKING DEVICE WITH SAFETY RETAINER

BACKGROUND OF THE INVENTION

This invention pertains to portable cooking devices, and more particularly to portable cooking devices having retainer means to safely secure cooking utensils above a burner device.

Various portable cooking devices have been developed for indoor or outdoor use. These cooking devices operate with various fuels, for example, wood, charcoal, electricity, liquid fuel or bottled gas. These devices are adaptable to allow various methods of cooking and various cooking utensils to be employed with a single unit. Food can be fried in a pan or on a griddle, boiled or deep-fried in a large pot, or grilled or broiled on a grill attachment.

Examples of portable cooking devices of such type can be seen in U.S. Pat. No. 4,553,524 to Wheat et al. and U.S. Pat. No. 3,763,846 to Schantz et al.

These portable cooking devices are by nature built to be used in various locations and will be placed on a variety of surfaces. These surfaces can vary from a table top to concrete pavement to grass to a vehicle tailgate, and therefore it is apparent that many situations may arise where the cooking device is used in a potentially unstable position. In addition to this, the known portable cooking devices are designed to use utensils which merely rest on top of the unit or sit within a small retaining shoulder. This design exposes the user to a hazardous condition, especially when a large pot of water or oil is heated to high temperature, such that a slight shifting of the cooking device or someone sliding the cooking pot off center can result is spillage of the hot oil or water onto the user.

Therefore, there is a need for a portable cooking device having a more stable configuration. There is a need for a portable cooking device having a safety feature which protects the user from the danger of burns from hot oil or water. There is a need for a portable cooking device having a safety feature which securely retains cooking utensils on the surface of the device.

BRIEF SUMMARY OF THE INVENTION

The present invention, to be described in further detail later, is a portable cooking device which can be used to cook foods at various locations using a variety of cooking methods and utensils. The invention comprises a housing structure containing a centrally located burner unit, the housing structure being inherently stable to provide a horizontal positioning for various cooking utensils such a pot, pan, griddle or grill. The term horizontal is defined herein as a direction perpendicular to the central axis of the housing structure and the term vertical is defined herein as a direction parallel to the central axis. The housing structure contains inner horizontal supports for supporting small utensils above the burner unit. Extending above the housing structure are support members having a shoulder configuration to receive a large pot positioned above the burner unit. The support members also provide a means to receive a grill or griddle above the burner unit. A plurality of legs may extend below the housing structure, raising the entire unit to greater height, thus providing more convenient access when the device is in use. The legs are formed such that the lower portion of each leg is perpendicular to the vertical axis, thus providing a stable base for the portable cooking unit.

Extending horizontally from the support members is a retaining means for securely retaining any large pot used with the device. The retaining means is an annular member which removably fits onto the upper part of the support members. The inner diameter of the annular member is slightly larger than the outer diameter of the large pot, allowing the pot to be easily inserted and removed, yet providing a secure restraint which prevents the pot from sliding off center or tipping over. The annular member is positioned a sufficient height above the shoulder configuration section of the support members to insure stability of the cooking utensil.

The burner unit is of the type designed to employ propane gas as fuel. It is an annular burner, having an inverted central truncated cone secured within an internal funnel-shaped cavity of the main burner body. The inner wall of the internal cavity has vertical channels which form a ring of outlets on the upper surface which delineate the flame pattern of the propane and air fuel mixture. Connected to the main burner body is a tubular venturi assembly to which the propane fuel source is attached. The design of the burner unit is such that an annular flame pattern is formed, which, because of the channels and ridges on the internal wall, is not susceptible to being extinguished by wind gusts. Numerous equivalent burner units are also known and may be substituted in use with this invention.

Accordingly, it is a general object of this invention to provide a portable cooking device capable of frying, boiling, or grilling on a single device through the use of interchangeable parts.

A more particular object of this invention is to provide a portable cooking device which incorporates a means to safely retain cooking utensils in place on the device.

Another object of this invention is to provide a portable cooking device which incorporates a safety ring as a retainer means to prevent large pots from sliding off the supporting members when the device is in use.

Another object of this invention is to provide a portable cooking device which incorporates a safety ring as a retainer means to prevent large pots from sliding off the supporting members when the device is in use, the safety ring being removable to allow the device to be used for alternative methods of cooking.

Another object of this invention is to provide a portable cooking device having a more stable leg design.

Another object of this invention is to provide a portable cooking device having an improved burner unit less susceptible to being extinguished by wind gusts.

DESCRIPTION OF BEST MODE AND PREFERRED EMBODIMENT

Figure 1:
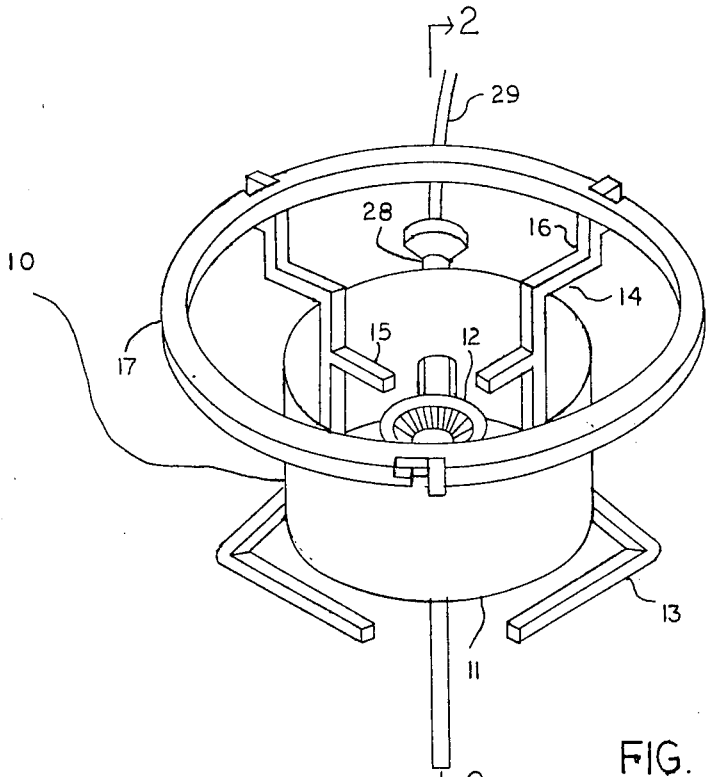
FIG. 1 is a perspective view of a portable cooking device embodying the features of the present invention.

Referring to FIG. 1, a portable cooking device embodying the features of the present invention is illustrated and indicated generally at 10. The device 10 includes a tubular housing 11, preferably formed of sheet metal. The housing 11 unifies the various elements of the device while functioning as a windscreen to protect the flame of burner 12 from being accidentally extinguished. The housing 11 is open at both ends to allow for sufficient flow of oxygen to reach the flame.

Extending from the bottom of housing 11 are legs 13, at least three in number. Legs 13 are preferably formed from square-profiled metal rods. Each leg 13 extends from housing 11 at a thirty degree angle to vertical. The lower section of each leg 13 is then bent inwardly toward the central axis of housing 11, such that the lower sections form a horizontal surface to provide support for the portable cooking device itself.

Figure 6:
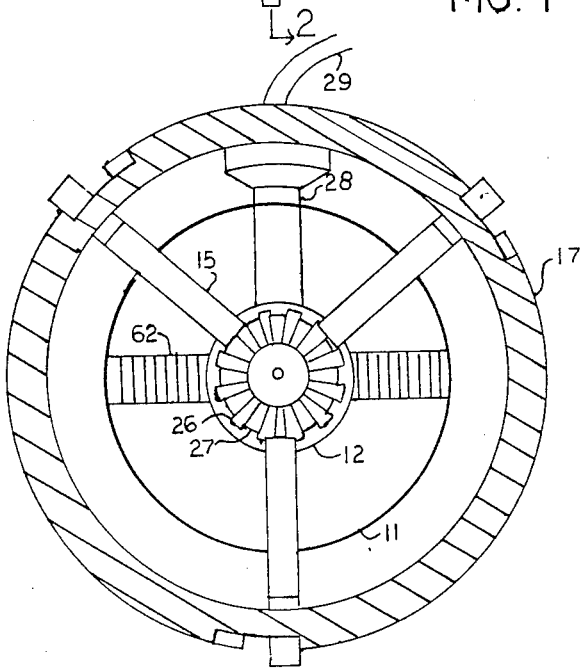
FIG. 6 is a top view of a portable cooking device embodying the features of the present invention.
Figure 2:
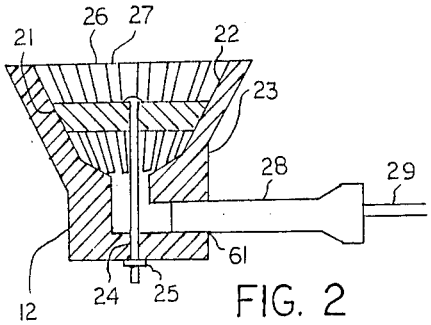
FIG. 2 is a cut-away cross-sectional view of the burner unit and inner member of the present invention, with other components shown as exposed, taken along line 2—2 of FIG. 1.

Centrally disposed within housing 11 is a metal burner device 12, as shown in FIG. 6. Burner 23 is mounted on a cross bar 62 attached at each end to housing 11. Burner 12 utilizes a mixture of propane gas and air to produce a number of flames in an annular pattern. With particular reference to FIG. 2, burner 12 comprises an inner member 21 in the shape of truncated cone. Inner member 21 fits into the funnel-shaped cavity 22 of the burner body 23 and is secured by a bolt 24 extending through an opening at the central axis of inner member 21 and an opening at the central axis of burner body 23. A fastening nut 25 maintains the inner member 21 securely in the burner body 23. The inner surface of the funnel-shaped cavity 22 consists of a repeating pattern of channels 26 and ridges 27, the channels allowing the propane gas and air mixture to pass up around inner member 21. Channels 26 and ridges 27 extend to the top of cavity 22. At the base of the burner body 23 is an aperture 61 into which fits a tubular venturi 28. Extending from the venturi 28 is a flexible tube 29 for connecting to a fuel source (not pictured). Venturi 28 can be of any of the commonly known versions designed to provide the proper mixture of air and fuel to burner 12.

Figure 3:
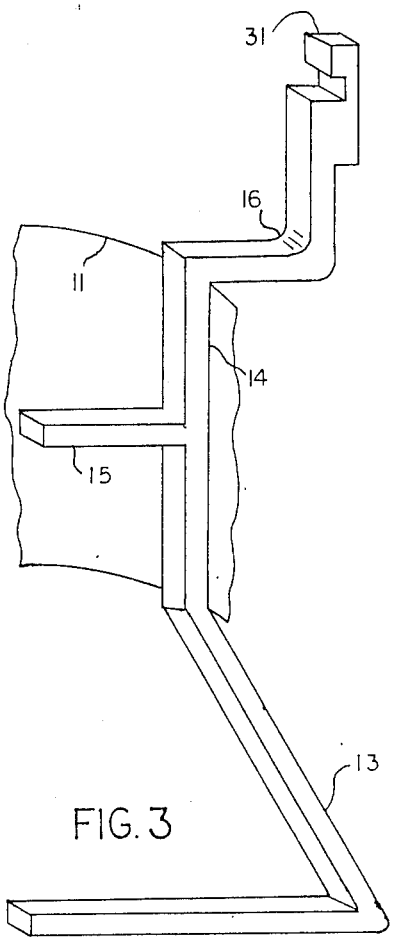
FIG. 3 is a perspective view of a support member of the present invention.

Again referring to FIG. 1, at least three support members, indicated generally at 14, are attached to the vertical inner wall of housing 11 by suitable fastening means. Support member 14 and leg 13 are preferably constructed as an integral unit. Referring to FIG. 3, extending horizontally from each support member 14 toward the central axis of housing 11 is an inner utensil support 15 formed preferably from a square-profile metal bar similar to that used to construct support members 14 and legs 13. Inner utensil support 15 functions as a base when small pots or pans are utilized above burner 12. Inner utensil support 15 is preferably welded to support member 14.

Figure 4:
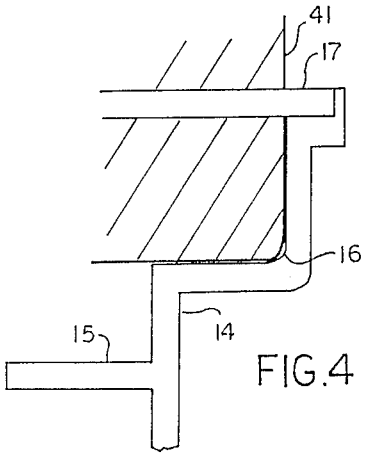
FIG. 4 is a profile view of a support member of the present invention illustrating the positioning of a large pot and the use of a retainer member of the present invention.

At a point immediately above housing 11, support member 14 is bent outwardly from the central axis at a ninety degree angle, forming a horizontal surface which is immediately followed by another ninety degree bend such that support member 14 again extends vertically. This section of support member 14 forms the utensil shoulder support 16. The design is such that a large circular pot 41 will fit secularly within the utensil shoulder support 16, as illustrated in FIG. 4.

Figure 5:
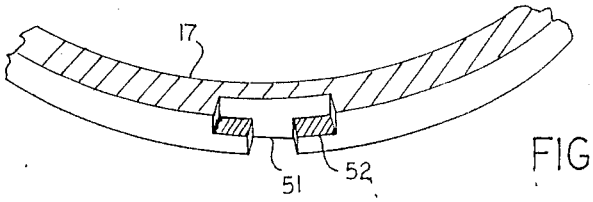
FIG. 5 is a perspective view of a portion of a retainer member of the present invention.

With reference again to FIG. 2, the device 20 also includes an annular retainer 17 which is fitted onto the tops of support members 14. The annular retainer 17 is formed from a rectangular profile metal bar. At selected points corresponding to the position of the tops of each support member 14, a reception slot 51 and tongue-rests 52 are cut into annular retainer 17, as shown in FIG. 5. Reception slot 51 allows annular retainer 17 to be fitted onto the top section of each support member 14. The top section of each support member 14 is notched to form a right-angle tongue 31, as shown in FIG. 3. The tongue 31 extends into the reception slot 51, and provides a locking mechanism with the tongue rest 52 when the annular retainer 17 is rotated axially in either direction. The annular retainer 17 encircles a large cooking pot 41 at a sufficient height to insure that the pot 41 cannot accidentally slide or tip off the cooking device, as shown in FIG. 4. For a pot 41 having a twelve inch diameter, the annular retainer 17 is located two inches above the utensil support shoulder 16. The annular retainer 17 can be removed from the support members 14 when the large cooking pot is not used, allowing a grill or griddle (not shown) to be placed on the cooking device for alternative types of cooking.

While one or more embodiments of the invention have been herein illustrated and described, it will be understood that those skilled in the art could develop modifications or variations which do not depart from the spirit of the invention, and that the scope of the invention is not to be limited by the above examples, but is to be ascertained by the nature of the following claims.

We claim:

1. A portable cooking device comprising:

(A) a housing for receiving a burner device;

(B) support means connected to said housing for holding a cooking utensil above said burner device, said support means including vertically extending members;

(C) retainer means for securing said cooking utensil upon said support means, the retainer means comprising a horizontal member connected to the upper portion of said vertically extending members of said support means, the horizontal member abutting said cooking utensil a sufficient distance above the bottom of said cooking utensil such that said cooking utensil cannot be slided or tipped off said support means.

2. The device in claim 1, wherein said vertically extending members of said support means comprise a plurality of arms extending from said housing, said arms having a portion formed in a right-angle for receiving said cooking utensil within the right angle portion.

3. The device in claim 2, wherein said horizontal member extends from each support means to the next adjacent support means.

4. The device in claim 3, wherein said horizontal member is annular.

5. The device in claim 2, wherein said horizontal member is removable.

6. The device in claim 1, wherein said horizontal member extends from each support means to the next adjacent support means.

7. The device in claim 6, wherein said horizontal member is annular.

8. The device in claim 1, wherein said horizontal member is removable.

9. A portable cooking device comprising:

(A) a tubular housing for receiving a centrally located burner device, (B) means for connecting said burner device to said housing, (C) means for positioning said housing above a horizontal surface, (D) support means for holding a cooking utensil above said burner device, said support means comprising a plurality of arms extending above said housing at spaced intervals, said arms having a portion formed in a right-angle for receiving said cooking utensil within the right-angle portion, (E) retainer means for securing said cooking utensil upon said support means, said retainer means comprising an annular ring fitted on the top of said arms.

10. The device in claim 9, wherein said annular ring is removable.

11. The device in claim 9, further comprising horizontal members extending from the inner surface of the housing towards the center, said horizontal members being above the surface of said burner device.

12. The device in claim 9, wherein said burner device comprises a body having an internal funnel-shaped cavity and an inner member in the shape of a truncated cone, the inner wall of the internal cavity having vertical channels and ridges to allow passage of a fuel-air mixture around the inner member.

13. The device of claim 9, wherein said means for positioning said housing above a horizontal surface comprise a plurality of legs having the lower section of each leg bent perpendicular to the central axis.

* * * * *